United States Patent [19]

De Ronde

[11] 4,327,342

[45] Apr. 27, 1982

[54] BANDSTOP FILTER FOR VERY HIGH FREQUENCY TRANSMISSION LINES AND BIASSING CIRCUIT FOR A VERY HIGH FREQUENCY TRANSISTOR COMPRISING THIS FILTER

[75] Inventor: Frans C. De Ronde, Lesigny, France

[73] Assignee: U.S. Philips Corporation, New York, N.Y.

[21] Appl. No.: 168,821

[22] Filed: Jul. 10, 1980

[51] Int. Cl.[3] ..... H01P 1/213; H01P 1/203; H01P 3/08

[52] U.S. Cl. ..... 333/204; 333/246

[58] Field of Search ..... 333/204–209, 333/202, 219, 220, 245, 246; 330/53–55, 57

[56] References Cited

U.S. PATENT DOCUMENTS 2,258,148 10/1941 Schüssler ..... 333/206

4,074,214 2/1978 Aichholzer ..... 333/219 X

*Primary Examiner*—Marvin L. Nussbaum

*Attorney, Agent, or Firm*—James J. Cannon, Jr.

[57] ABSTRACT

A bandstop filter for very high frequency transmission lines having distributed constants, having several filtering elements each intended to prevent the transmission of a specific frequency band. The first filtering element is a quarter-wave filter, the second element an assembly of two transmission paths of a length such that the signals present at the outputs have opposite phases and cancel other, the third element being a quarter-wave filter, these elements being grouped such that they form an extremely compact filter which is little sensitive to proximity effects.

5 Claims, 4 Drawing Figures

BANDSTOP FILTER FOR VERY HIGH FREQUENCY TRANSMISSION LINES AND BIASSING CIRCUIT FOR A VERY HIGH FREQUENCY TRANSISTOR COMPRISING THIS FILTER

BACKGROUND OF THE INVENTION

The present invention relates to a bandstop filter for very high frequency transmission lines having distributed constants and implemented in planar structure, more particularly in accordance with the microstrip technique, as well as to a biassing circuit for a very high frequency transistor comprising this filter.

A conventional technique for ensuring the reception of a very high frequency signal is to include in the receiver a mixer which receives on the one hand this useful very high frequency signal of the frequency $f_S$ and on the other hand a signal of the frequency $f_{OL}$ produced by a local oscillator and which produces a signal having an intermediate frequency $f_{FI}$ which is equal to the difference between the frequencies $f_S$ and $f_{OL}$. This mixer must be followed by a filter which prevents the transmission of the frequencies $f_S$ and $f_{OL}$ and promotes the transmission of the weakest frequency $f_{FI}$, that is to say a low-pass filter or at least a band-stop filter.

Such filters are included in the amplifier stage described in "Proceedings of the 4$^{th}$ European Microwave Conference", Montreux, September 1974, pages 97 to 100, (see FIG. 2), or in the oscillator stage described in "Proceedings of the 5$^{th}$ European Microwave Conference", Hamburg, September 1975, pages 296 etc (see FIG. 4). Nevertheless, when this filter is used alone, as is the case in the second paper, a very narrow band of this filter is cutoff and it is not suitable for the above-intended use. When, on the contrary, several filters are used in conjunction, it is possible that a wider band is cutoff but this is offset by the fact that other disadvantages are created, notably the fact that the overall filter thus realized becomes bulky and no accurate positioning of the filter with respect to the mixer is possible.

It is an object of the invention to provide a bandstop filter for very high frequencies which does not require such compromises which are inevitably unsatisfactory, and which is extremely compact while having a cutoff band which is sufficiently large and offering a properly defined plane of short-circuit with respect to the mixer to optimize the efficiency of this mixer.

To this end the invention relates to a bandstop filter which is characterized in that it comprises:

(a) a first filtering element intended to prevent the transmission of a first frequency band and comprised of a quarter-wave filter having electrical length equal to one quarter of the wavelength $\lambda_1$ associated with the centre frequency of this first band, arranged at the input point of the bandstop filter and defining there a plane of short circuit, (b) a second filtering element intended to prevent the transmission of a second frequency band which is adjacent to the first band and which is comprised of an assembly of two parallel transmission paths which separate at the input point of the bandstop filter and come together again at the output point of this bandstop filter such, that the electric length of each of these two paths is equal to an odd number of times one quarter of the wavelength $\lambda_2$, which is associated with the center frequency of the second frequency band and that the difference between these lengths is equal to an odd number of times half this wavelength. Preferably, this second filtering element is a closed loop having an electric length equal to $\lambda_2$ and transversely connected to the very high frequency transmission line in the input and output points of the bandstop filter which are spaced on this loop at a distance equal to $\lambda_2/4$, and that the first filtering element is positioned within this loop.

The bandstop filter thus realized occupies in a very efficient manner very little space, since the combination of these two filtering elements and a proper choice of their dimensions render it possible to obtain the desired width of the cutoff band at one's option. In addition, connecting these two filtering elements to the same point, at the input point of the filter, defines in a unique and accurate manner the plane of short circuit of the signals whose transmission one wants to prevent, which renders the action of the filter in practice independent of the frequency in the cutoff band (20 to 30%). In order to render the band which was cutoff by this filter still wider and to eliminate the second harmonic of the center frequency of either the one or the other of the two frequency bands which were already eliminated by the first and the second filtering elements, this filter may comprise at least a third filtering element intended to prevent the transmission of a third frequency band centered around the frequency of double the center frequency of the first frequency band and comprised of a quarter-wave filter of the electrical length $\lambda_1/8$, which is arranged in parallel with one of the two transmission paths at a distance from the input point of the bandstop filter equal to (n-1) $\lambda_2/2$, and is a positive integer which is compatible with the length of the transmission path, or, alternatively, intended to prevent the transmission of a third frequency band centered around the frequency which is double the center frequency of the second frequency band and being comprised of a quarter-wave filter of an electrical length $\lambda_2/8$ arranged in parallel with one of the two transmission paths at a distance from the input point of the bandstop filter equal to (n-1) $\lambda_2/2$, and being a positive integer which is compatible with the length of the transmission path.

BRIEF DESCRIPTION OF THE DRAWINGS

Further details and advantages of the invention will be better understood from the following description with reference to the accompanying drawings, which show by way of non-limitative examples some embodiments of the invention and in which.

DESCRIPTION OF THE PREFERRED EMBODIMENTS

Figure 1:
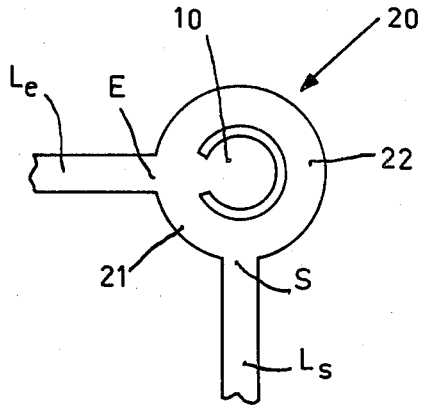
FIG. 1 shows a first embodiment, having two filtering elements, of the bandstop filter according to the invention.

The bandstop filter shown in FIG. 1 has an input point E to which an upper portion $L_e$ of the transmission line incorporating the filter is connected, and an output point S to which a lower portion $L_s$ of this transmission line is connected. According to the invention, this bandstop filter is comprised of a first filtering element 10 and a second filtering element 20, which are intended to prevent the transmission of a first frequency band and a second frequency band adjacent to the first frequency band, respectively.

The element 10 is comprised of a quarterwave filter having an electrical length equal to a quarter wavelength $\lambda_1$ which is associated with the center frequency of the first frequency band and is arranged at the input point E of the bandstop filter. The element 20 is comprised of an assembly of two parallel transmission paths 21 and 22, which separate at the input point E, in the plane of short-circuit defined by the presence of the first filtering element 10, by-pass the element 10 and come together again at the output point S. In the example described here the first transmission path 21 follows a path in the form of an arc of a circle of an electrical length $\lambda_2/4$ ($\lambda_2$ being the wavelength associated with the center frequency of the second frequency band), whereas the second path 22 follows a path in the form of a complementary arc of a circle of an electrical length 3 $\lambda_2/4$. At point S, where the transmission paths 21 and 22 come together again, the signals having the frequency corresponding to the wavelength $\lambda_2$ arrive therefore in that point S with opposite phases and not any signal of this frequency is transmitted to the portion $L_s$ of the transmission line.

As will be apparent, the bandstop filter has a very small circumference, since the circular shape adopted for the element 20 requires very little space and the first filtering element is placed inside the second element. Furthermore, the insulation provided by the bandstop filter embodying the invention is excellent, and is only limited by the parasitic coupling (higher modes) which may appear between E and S (an attenuation of 60 dB can, for example, be obtained if one does not want to have a passband higher than some percents).

It will be evident that the electrical length of the two transmission paths may be longer than the electrical length of the above-described example; the only important fact is that each of the two lengths must be equal to an odd number of times the quarter wavelength $\lambda_2$ and that the difference between its lengths must be equal to $$\frac{\lambda 2}{2}(2m-1)$$

to ensure that the phase opposition has been properly obtained is S (m may be any positive integer). The above described example, which corresponds to m=1, corresponds to the most compact embodiment, which is therefore, and that in more than one respect, the most advantageous embodiment, on the one hand for applications where a small size of the component is of prime importance, and on the other hand to provide a better concentration of the electric and magnetic fields and thereby render the filter less sensitive to proximity effects.

In the application referred to in the foregoing, the wavelength $\lambda_1$ is, for example, the wavelength which is associated with the received, useful very high frequency signal of the frequency $f_S$ which is intended for the mixer (for example a very high frequency diode), and the wavelength $\lambda_2$ is the wavelength which is associated with the signal of the frequency $f_{OL}$ produced by the local oscillator and which is also applied to the mixer. The lower portion $L_s$ of the transmission line receives only the signal of the frequency $f_{FI}$, which is produced by the non-linear component which forms the mixer; the signals of the frequencies $f_S$ and $f_{OL}$ cannot reach this portion $L_s$, because of the combined action of the filtering elements 10 and 20.

Figure 2A:
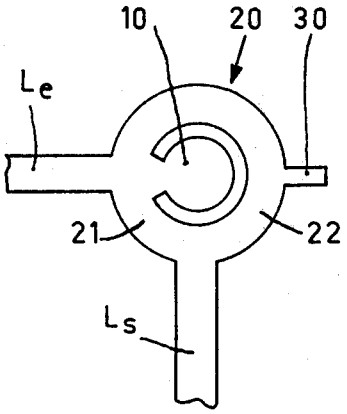
FIGS. 2*a* and 2*b* show two other embodiments having three filtering elements of the bandstop filter according to the invention.

An increase of the frequency band which is cut off by the filter embodying the invention, may be obtained when, in accordance with FIG. 2*a*, this filter comprises a third filtering element 30, which has for its purpose to prevent the transmission of a third frequency band which is centered around the frequency of double the center frequency of the second frequency band. Actually, still referring to the use mentioned in the foregoing, the signal of frequency $f_{OL}$ produced by the local oscillator has an amplitude which generally is well above the amplitude of the received, very high frequency signal of the frequency $f_S$, and the presence of the second harmonic of this signal of the frequency $f_{OL}$ corresponds therefore to a considerable loss in energy. Introducing the third filtering element 30 renders it possible to prevent the transmission of this harmonic and to avoid deterioration of the efficiency resulting from such a transmission. This third filtering element may, of course, also be provided, if necessary, to prevent the transmission of a third frequency band centered around the second harmonic of the center frequency of the first frequency band, and no longer of the second band.

In both cases the third filtering element 30 is a quarter-wave filter which is arranged in parallel with the second transmission path 22 at a distance from the input point E of the stopband filter equal to $\lambda_2/2$ (or, when the transmission paths are longer than the transmission paths of the embodiments shown in the Figures, equal to n $\lambda_2/2$, n being a positive integer which is compatible with the se/lengths). The length of this filter is $\lambda_2/8$ when it is desired to eliminate the second harmonics of the signal filtered by the second filtering element 20, or $\lambda_1/8$ if it is desired to eliminate the second harmonic of the signal filtered by the first filtering element 10.

Figure 2B:
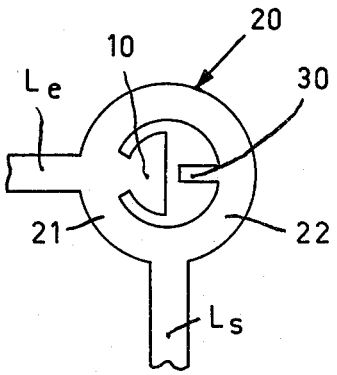

Compared with FIG. 2*a*, where the third filtering element 30 is connected to the transmission path 22 on the outer portion of the ring, FIG. 2*b* shows a variation of the embodiment in which this element 30 is directed towards the interior of the ring. This variation is very advantageous as the bandstop filter embodying the invention remains extremely compact, in spite of the presence of an additional filtering element.

Figure 3:
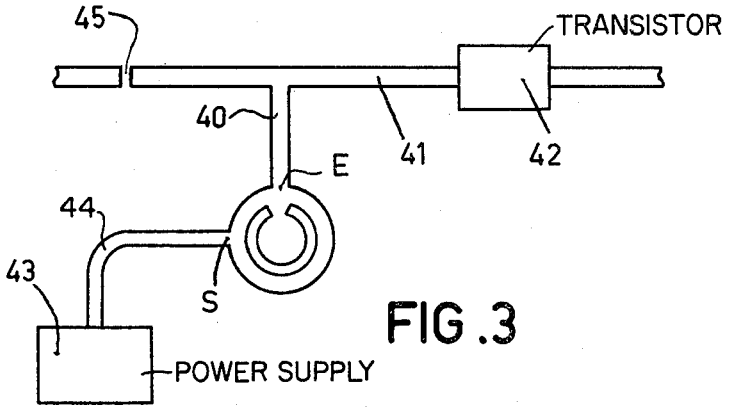
FIG. 3 shows how the invention can be used to bias a very high frequency transistor.

In the foregoing description frequent mention has been made of the principal use of the filter according to the invention namely its use in a very high frequency receiver. FIG. 3 shows an alternative application of the invention, namely incorporation of the bandstop filter in the biassing circuit of a very high frequency transistor. The bandstop filter according to the invention is connected (perpendicularly in the present case), in its input point E, to a section 40 of the transmission line which is arranged in parallel with a transmission line 41, which comprises a very high frequency transistor 42 and a capacitor 45. The length of the section 40 is equal to the quarter wavelength associated with the very high frequency signal which traverses the transmission line 41. Furthermore, the filter is connected (perpendicularly) in its output point S, to a power supply circuit 43 of the transistor 42. This arrangement renders it possible for circuit 43 to ensure biassing of the transistor 42 by transmitting its biassing voltage through the line section 44, the bandstop filter (for example the filter as shown in FIG. 1), line section 40 and line 41. Conversely, the very high frequency signal flowing through line 41 cannot reach circuit 43 becuse of the efficient barrier formed by the bandstop filter. The filtering action is of a higher still efficiency when section 40 is given the highest possible impedance.

It will be apparent that the present invention is not limited to the few embodiments described in the foregoing and shown in the drawings, but that on the basis of these embodiments further embodiments can be realized without going beyond the scope of the invention. More particularly, the circular arrangement of the two transmission paths of the second filtering element is admittedly the most compact arrangement possible, but a square or rectangular arrangement, for example, remains very compact and is therefor almost as advantageous as the arrangement described in the foregoing and shown in the drawings.

What is claimed is:

1. A bandstop filter for very high frequency transmission lines having distributed constants and implemented in a planar structure, more particularly in accordance with the microstrip technique, characterized in that is comprises:

(a) a first filtering element intended to prevent the transmission of a first frequency band and comprised of a quarter-wave filter having an electrical length equal to one quarter of the wavelength $\lambda_1$ associated with the center frequency of this first band, arranged at the input point of the bandstop filter and defining there a plane of short circuit, (b) a second filtering element intended to prevent the transmission of a second frequency band which is adjacent to the first band and comprised of an assembly to two parallel transmission paths which separate at the input point of the bandstop filter and come together again at the output point of this bandstop filter such, that the electrical length of each of these two paths is equal to an odd number of times one quarter of the wavelength $\lambda_2$ associated with the center frequency of the second frequency band and that the difference between these lengths is equal to an odd number of times half this wavelength.

2. A bandstop filter as claimed in claim 1, characterized in that the second filtering element is a closed loop of an electrical length equal to $\lambda_2$ and being transversely connected to the very high frequency transmission line in the input and output points of the bandstop filter arranged on this loop at a mutual distance equal to $\lambda_2/4$ and that the first filtering element is arranged within this loop.

3. A stopband filter as claimed in claim 1 or claim 2, characterized in that it comprises at least a third filtering element intended to prevent the transmission of a third frequency band which is centered around the frequency of double the center frequency of the first frequency band and comprised of a quarter wave filter having an electrical length $\lambda_1/8$ arranged in parallel with one of the two transmission paths at a distance from the input point of the bandstop filter equal to (n-1) $\lambda_2/2$, n being a positive integer which is compatible with the length of the transmission path.

4. A bandstop filter as claimed in claim 1 or claim 2, characterized in that it comprises at least a third filtering element intended to prevent the transmission of a third frequency band which is centered around the frequency which is double the center frequency of the second frequency band and comprised of a quarter wave filter having an electrical length $\lambda_2/8$ arranged in parallel with one of the two transmission paths at a distance from the input point of the bandstop filter equal to (n-1) $\lambda_2/2$, n being a positive integer which is compatible with the length of the transmission path.

5. A biasing circuit for a very high frequency transistor, comprising a bandstop filter as claimed in claim 1 and characterized in that the input point of the filter is transversely connected to a section of the transmission line which itself is arranged in parallel with a transmission line which is connected to the very high frequency transistor, and in that the output point of the filter is connected perpendicularly to a power supply circuit of this transistor, the electrical length of the section between the input point of the bandstop filter and the transmission line being equal to one quarter of the wavelength associated with the very high frequency signal passing through this transmission line.

* * * * *